US005876076A

United States Patent [19]

Kosky

[11] Patent Number: 5,876,076

[45] Date of Patent: Mar. 2, 1999

[54] TAMPER INDICATION APPARATUS

[75] Inventor: Julius Kosky, Edgware, United Kingdom

[73] Assignee: Mecom Standard Limited, London, England

[21] Appl. No.: 731,022

[22] PCT Filed: Feb. 7, 1996

[86] PCT No.: PCT/GB96/00254

§ 371 Date: Jan. 30, 1997

§ 102(e) Date: Jan. 30, 1997

[87] PCT Pub. No.: WO96/24920

PCT Pub. Date: Aug. 15, 1996

[30] Foreign Application Priority Data

Feb. 9, 1995 [GB] United Kingdom ..... 9502715

[51] Int. Cl.[6] ..... B65D 27/30

[52] U.S. Cl. ..... 292/307 R; 70/436

[58] Field of Search ..... 292/307 R, 315, 292/325; 70/436, 433, 437

[56] References Cited

U.S. PATENT DOCUMENTS

| | | | |
|---|---|---|---|
| 439,623 | 11/1890 | Beasley | 70/436 |
| 506,647 | 10/1893 | Littell | 70/436 |
| 585,016 | 6/1897 | Aldrich | 70/436 |
| 923,584 | 6/1909 | Ruddy | 70/436 |
| 1,578,060 | 3/1926 | Nash | 70/436 |
| 1,590,046 | 6/1926 | Man | 70/436 |
| 2,700,360 | 1/1955 | Stegman . | |
| 4,118,057 | 10/1978 | Michael . | |
| 4,766,419 | 8/1988 | Hayward . | |

FOREIGN PATENT DOCUMENTS

| | | |
|---|---|---|
| 618 559 | 10/1994 | European Pat. Off. . |
| 618559 | 10/1994 | European Pat. Off. . |

*Primary Examiner*—Steven Meyers
*Assistant Examiner*—Gary Estremsky
*Attorney, Agent, or Firm*—Pillsbury Madison & Sutro,LLP

[57] ABSTRACT

A security device comprises a cable whose ends are engageable within a plunger. The cable is threaded around a door handle or other item to be secured and then, with the cable ends engaged therein, the plunger is slid within a housing for retention by a locking slide. Retraction of the plunger into the housing moves a slide upwardly. This movement causes a pivotally mounted striker to be flipped from one end position to another by an over-center spring arrangement. In moving, the striker strikes a number of wheels each carrying a sequence of numbers. The wheels are rotated and a random number is displayed. If, subsequently, the plunger is released to release the cable, the wheels are struck again by the striker whereby the displayed number is changed. The number is changed again if the plunger is repositioned. The chance of the same number being randomly generated is insignificant. Thus, any opening and closing of the security device is immediately apparent because of the change in the number displayed.

8 Claims, 6 Drawing Sheets

TAMPER INDICATION APPARATUS

The present invention relates to tamper indication apparatus.

Such apparatus is particularly useful to indicate whether undesired access to a restricted location, region, receptacle, container or area etc. has been attempted, or achieved.

One known tamper indicator comprises a so-called electric security seal which forms the subject matter of published European Patent Application EP-A-0 618 559.

Known devices of this type are of an electronic nature and thus require a power source. Once enabled to provide for tamper indication, the known device displays alpha-numeric information generated in a random manner at the time of establishing a seal. If the seal is broken, i.e. in an attempt to gain access to the secured receptacle or other container, any attempt to reseal the device, i.e. in an attempt to disguise the attempted, or successful, access to the receptacle or container, causes the device to electronically generate a further random alpha-numeric display. This display, in view of the random nature of the generation of the numbers/letters, has an insignificantly small probability of displaying the previous random number or letters. The randomly generated alpha-generic information is displayed electronically.

Disadvantages are however experienced with such known apparatus in that the continued accurate operation thereof is dependent upon the provision of a sealed power source which has a limited life. Also, the known apparatus suffers from robustness limitations. Furthermore, the known apparatus only generates a further random number when an attempt is made to reseal the device.

It has been found that such known apparatus can only have limited use.

The present invention seeks to provide tamper indication apparatus having advantages over known tamper indication apparatus.

In accordance with the present invention there is provided a tamper indication apparatus comprising movable indicia means arranged to be visible from outside the apparatus, drive means for imparting movement to said movable indicia means to alter in a random manner the visible indicia, and retainer means selectively engageable with said movable indicia means to retain them against movement, wherein said drive means is arranged to be actuable in response to an opening/closing force and/or an opening/closing movement of a security device associated with said tamper indication apparatus.

An embodiment of apparatus of invention advantageously provides tamper indicator apparatus having a simple mechanical structure, and mechanism, capable of achieving the random generation of a tamper-indication code without the identified disadvantages of the prior art.

The movable indicia means may advantageously have an at least part arcuate surface, which preferably has a plurality of indicia provided thereon. In this manner, the movable indicia means may advantageously be arranged rotatably, or pivotally, within the apparatus so as to allow for the viewing of different portions of said arcuate surface and thus different indicia.

In particular, the movable indicia means may comprise rotatable means which, in one particular embodiment, may comprise wheel means.

In a presently preferred embodiment, said movable indicia means comprise a number of wheels each having a plurality of indicia provided on the circumferential surface thereof.

The provision of wheels or wheel means is particularly advantageous having regard to the required generation of a potentially large number of random positions of the indicia means. A plurality of indicia means are advantageously provided on the circumferential surface of each said wheel, for example.

To enhance the security function of the apparatus, the movable indicia means advantageously comprises a plurality of discrete movable indicia members.

Such members are advantageously provided with similar dimensions and, in particular, are arranged to rotate freely and independently.

In order to achieve a particularly compact construction of the apparatus of the present invention, the said plurality of movable indicia members may advantageously be mounted for movement about a common axis which may, therefore, advantageously be formed by a common axle member.

In a presently preferred embodiment, a plurality of discrete wheels are mounted for movement about a common axis.

Further, the plurality of movable indicia members may advantageously be arranged in an adjacent manner such that the indicia displayed by each such movable member appear as a series code and/or code number.

For example, said wheels may be arranged to be adjacent whereby the indicia displayed by said wheels appear as a series code and/or code number.

It will, of course, be appreciated that any required indicia may be provided on said movable indicia means, but particular forms may comprise numbers or letters, or indeed a combination thereof.

Preferably, said drive means may comprise formations provided on the said movable indicia means.

Such formations may advantageously comprise magnetic formations so that movement of a magnetic member relative thereto may effect movement of said movable indicia means. The security device may itself be provided with magnetic means for influencing the movement of said movable indicia means. Alternatively, the security device may be arranged to effect movement of a movable magnetic member of said tamper indication apparatus which is itself located remote from said movable indicia means.

In one particular embodiment, said formations of said movable indicia means comprise engagement formations arranged to be engaged by said drive means.

In this manner, said drive means is advantageously arranged to be movable so as to engage said engagement formations of said movable indicia means.

In a preferred embodiment, said drive means is arranged to be actuable in response to an opening/closing movement of an associated security device, and wherein said drive means is movable to impart movement to said movable indicia means.

In particular, said drive means may be arranged to strike against said movable indicia means to impart freerunning movement thereto.

Advantageously, said drive means comprises a pivotally mounted arm member. Said pivotally mounted arm member may have a striking portion at one end thereof arranged, for example, for engagement with the engagement formations of said movable indicia means.

In an embodiment, said pivotally mounted arm member is reciprocable, and wherein pivotal movement in each direction is by way of a spring force. Preferably, said pivotally mounted arm is arranged to impart movement to said movable indicia means during its movement in each direction.

An embodiment of the present invention comprises a plurality of movable indicia members, and in this case the apparatus of the present invention may comprise drive means which comprise a respective plurality of drive members for imparting movement to each of the movable indicia members respectively.

Preferably, resilient means is provided to effect at least part of the motion of said drive means. In particular, said drive means may be at least part spring-operated. A tension spring may then advantageously be used to effect the aforesaid at least partial rotation of said drive means and, in particular, the striking-motion of said drive means.

Further, said drive means is advantageously movable between two positions wherein, during the movement between said positions, said drive means is arranged to effect movement of said movable indicia means.

According to a particularly advantageous feature of the present invention, the resilient member which engages said drive means is also arranged to engage a slide which is arranged to move relative to said drive means.

In a preferred embodiment, said tamper indication apparatus further comprises a reciprocal slide arranged to be moved by movement of an associated security device, said slide being arranged to effect movement of said drive means.

For example, said tamper indication apparatus may further comprise biasing means for biasing said slide towards a first, unlocked position.

Advantageously, said slide may be arranged to move under the influence of a movable member of the security device so as to alter the position of the point of engagement between said resilient means and said slide relative to the point of engagement between said resilient means and said drive means. In particular, said slide may be arranged to be moved so as to alter the position of the point of engagement of the resilient means with the slide relative to the point at which said drive means is mounted within the apparatus. This feature is particularly advantageous when said drive means is pivotally mounted within said apparatus.

Advantageously, the movement of said drive means to effect movement of said movable indicia member may then be effected between its two aforementioned positions, and in both directions therebetween, under at least partial influence of said resilient means.

As such, the movement of said drive means that effects the movement of said movable indicia means may advantageously be achieved by way of the bias of said resilient means.

Further, said slide may comprise an urging member for at least initiating the movement of said drive means in at least one of its directions of movement. Preferably, said urging member not only initiates the movement of said drive means from one position, but assists in securely retaining said drive means in the other of said positions.

The invention thus provides a simple and effective mechanism for achieving repeated movement of said movable indicia means in response to movement of the slide within the apparatus.

Preferably, said retaining means is arranged to engage with said movable indicia means and, for example, to engage with said engagement formations of said movable indicia means.

Advantageously, the movement of said retaining means into engagement with said engagement formations of said movable indicia means is timed so as to occur after said drive means has effected movement of said movable indicia means.

The aforementioned timed relationship may advantageously, and simply, be achieved by providing said retainer means on said slide. Thus, by appropriately positioning said retainer means on said slide relative to the urging member and/or the point of connection between said resilient means and said slide, movement of said slide first effects movement of said drive means so as to effect movement of said movable indicia means, and subsequently effects movement of said retainer means into a position of engagement with said engagement formations of said movable indicia means.

Further, said retainer means may advantageously be arranged to enter into a position of engagement with said engagement formations of said movable indicia means as said urging means approaches the position at which it secures the location of said drive means.

Advantageously, said slide is resiliently mounted within said apparatus. In particular, said slide is arranged to be movable between two positions and said apparatus comprises biasing means for biasing said slide into one of said two positions.

The biasing means of said apparatus may be arranged to bias said slide towards the position in which said retainer means is remote from said movable indicia means.

The apparatus may further be provided with actuator means which extend from said slide and which may be arranged to be engaged by said movable member of a security device. Preferably, said actuator means is provided integrally with said slide and extends through a housing of said apparatus by way of sealed aperture means.

In an embodiment, said slide carries or actuates said retainer means, and wherein said retainer means are arranged to engage said movable indicia means by movement of said slide, against the action of said biasing means, away from said first unlocked position to a second, locked position of said slide.

The tamper indication apparatus may further comprise actuator means carried by said slide and arranged to be engageable by a movable member of said security device.

Advantageously, said apparatus is provided within a sealed housing having sealed aperture means through which said actuator means extend.

Where the tamper indication apparatus comprises a plurality of movable indicia members, said actuator means may comprise at least two rods extending outwardly of said apparatus from said slide.

The invention may also comprise a security device, for example a lock, which incorporates the tamper indication apparatus defined above.

The invention also extends to a security device comprising a locking member movable between a locked and an unlocked position, and a tamper indication apparatus as defined above, wherein movement of said locking member is arranged to cause actuation of said drive means.

Embodiments of the present invention will hereinafter be described, by way of example, with reference to the accompanying drawings, in which.

Figure 1:
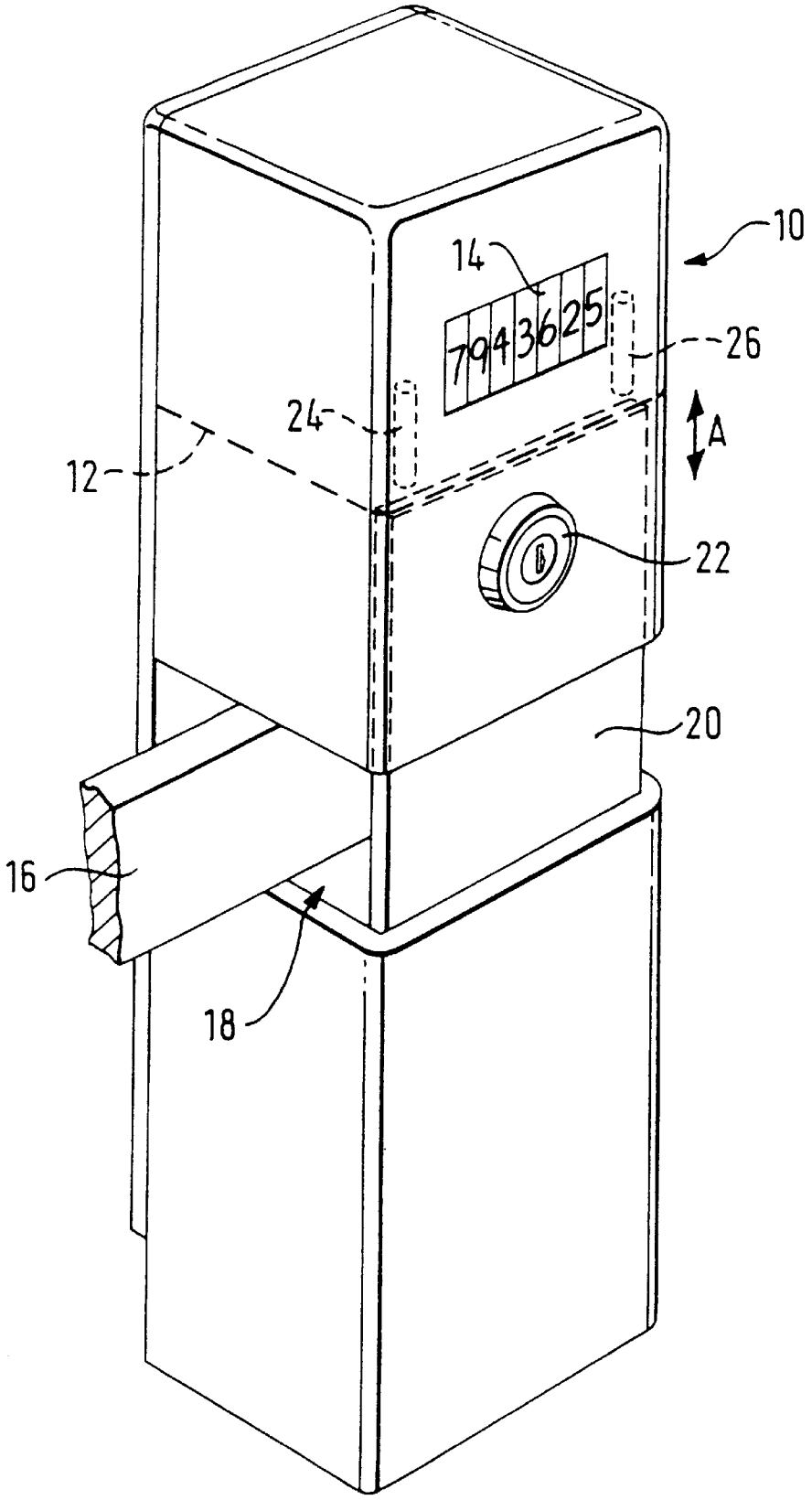
FIG. 1 is a perspective view of an embodiment of a lock incorporating tamper indication apparatus embodying the present invention.

Referring first to FIG. 1, there is shown a lock 10 which incorporates tamper indication apparatus 12 embodying the present invention. As will be appreciated from the description that follows, the tamper indication apparatus 12 is arranged to display a random number at a display 14.

The lock 10 is arranged to receive a hasp 16 of a locking arrangement in a gateway 18 formed in the body portion of the lock. A locking plate 20 is arranged for sliding reciprocal motion within the body portion of the lock 10 for selective opening, and closing, of the entry/exit to the gateway 18. The locking plate 20 is mounted for sliding motion in the direction of arrows A and, as shown in FIG. 1, the locking plate 20 is locked in a position in which it prevents removal of the hasp 16 from the gateway 18. The locking plate 20 is securely retained in this position by use of a locking key (not shown) in an associated key hole 22.

When the locking plate 20 is in its locking position, the upper surface thereof is located closely adjacent to, or indeed in engagement with, a peripheral portion of the underside of the tamper indication apparatus 12. It is at this peripheral portion of the tamper indication apparatus 12 that a pair of rods 24, 26 are mounted within the tamper indication apparatus 12.

The rods 24, 26 are normally biased into a position in which they extend downwardly, according to the orientation of the drawings, from the underside of the tamper indication apparatus 12. However, with reference to FIG. 1, and as will be appreciated from the description that follows, the movement of the locking plate 20 into the illustrated locking position pushes the rods 24, 26 up into the tamper indication apparatus 12. In this respect, movement of the locking plate 20 is arranged to effect movement of the rods 24, 26 from an extended position, in which they extend from the underside of the tamper indication apparatus 12, to a retracted position in which they are moved into the tamper indication apparatus 12.

Figure 2:
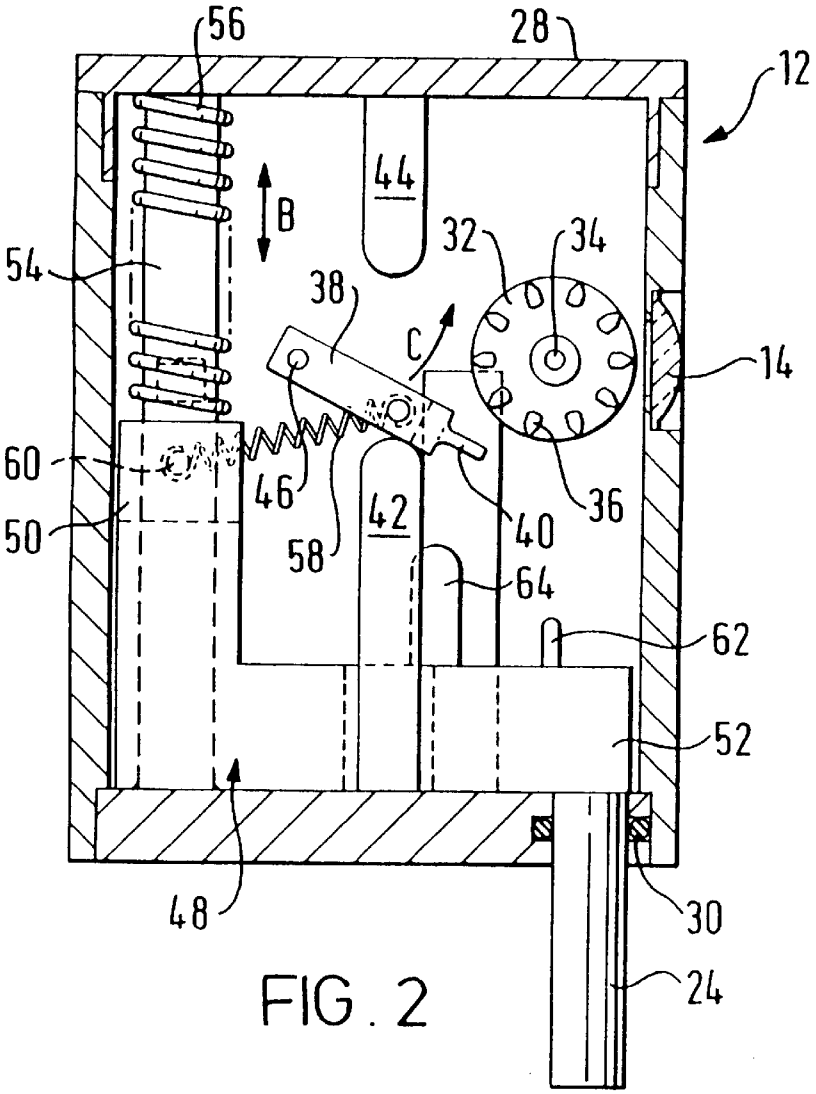
FIG. 2 shows diagrammatically a side view of the tamper indication apparatus of FIG. 1.

As can be seen in FIG. 2, the tamper indication apparatus 12 comprises a sealed housing 28, which is arranged to securely enclose the mechanism of the tamper indication apparatus 12 but which has a pair of sealed apertures 30 (only one shown in FIGS. 2 and 3) through which the respective rods 24, 26 (only rod 24 is shown in FIG. 2) extend. The apertures 30 can be sealed by an appropriate seal.

Figure 4:
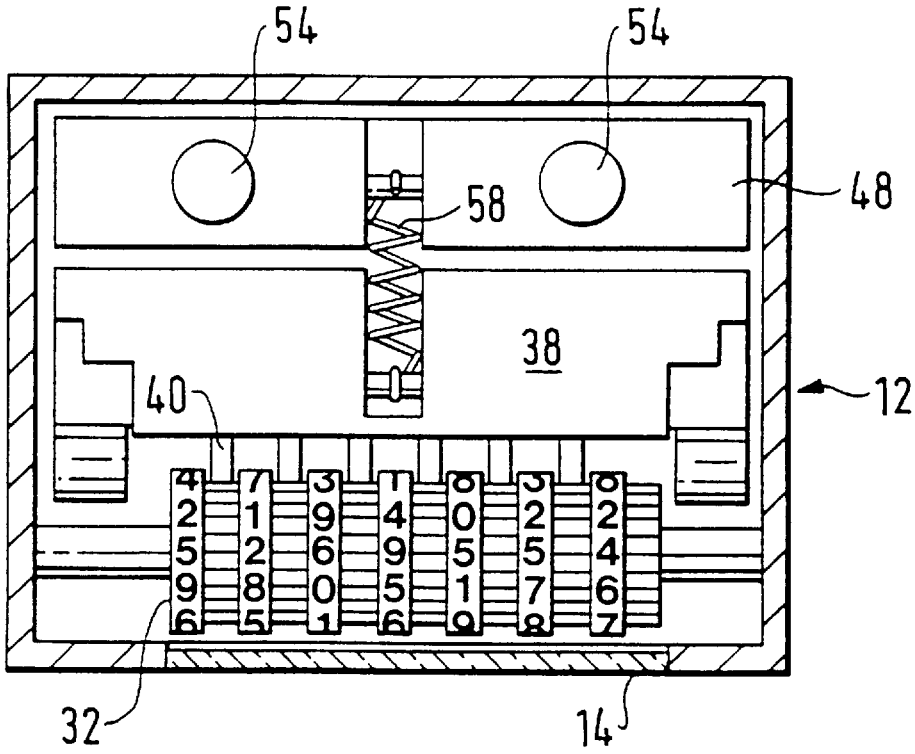
FIG. 4 is a diagrammatic plan view of the tamper indication apparatus of FIGS. 2 and 3.

The mechanism of the tamper indication apparatus 12 is described as follows. A series of independently rotatable wheels 32 are mounted for rotation about an axis 34 which extends substantially transversely relative to the rods 24, 26 (and into the drawing as shown in FIG. 2). The circumferential region of each of the wheels 32 is provided with spaced teeth 36 which provide engagement formations to be engaged by a drive member in the form of a striker 38 having a plurality of feet 40 extending from one end thereof (as best seen in FIG. 4).

The housing 28 is provided with inwardly extending stop members 42, 44 against which the striker member 38 rests when in each of two stationary positions.

The striker 38 is pivotally mounted about a pivot axis 46 which extends substantially parallel to the axis of rotation 34 of the wheels 32.

A slide 48 is disposed within the housing 28 and mounted for movement therein. The slide 48 is substantially L-shaped in cross-section and defines an upwarding extending portion 50 and a laterally extending base portion 52. The laterally extending base portion 52 extends transversely within the housing 28. The rods 24, 26 are connected to an end region of the base portion 52 and are preferably integrally formed therewith.

The upward extension 50 of the slide 48 is arranged for movement upon a pair of guide rails 54 (only one of which is visible in FIGS. 2 and 3) so that the slide 48 is movable within the housing 28 in the directions of the arrows B.

A pair of compression springs 56 (only one of which is visible in FIGS. 2 and 3) are also mounted around the pair of guide rails 54 and, as will be appreciated, serve to urge the slide 48 into its lowermost position as illustrated in FIG. 2. That is, the slide 48 is biased into its lowermost, unlocked position.

An extension spring 58 is connected between an end region of the striker 38, adjacent to the feet 40, and an end region 60 of the upward extension 50 of the slide 48. The extension spring 58 is connected so as to be continually under tension.

A row of retaining teeth 62 are arranged to extend upwardly from the upper surface of the base portion 52 of the slide 48. These retaining teeth 62 are arranged to engage between adjacent teeth 36 of the wheels 32 so as to prevent further rotation of the wheels 32. A pair of upstanding fingers 64 extend substantially parallel to the retaining teeth 62 but to a height greater than that of the retaining teeth 62.

FIG. 2 illustrates the condition of the tamper indication apparatus when the lock is open. In this condition the slide 48 is in its lowermost position. When the lock 10 is to be locked to retain the hasp 16, the locking plate 20 is moved upwardly. This imparts upward movement to the rods 24, 26 and hence to the slide 48. The slide 48 is moved upwardly against the bias of the compression springs 56. During this upward movement, the location of the point of contact 60 between the extension spring 58 and the upward extension 50 of the slide 48 begins to move from below (FIG. 2), to above (FIG. 3) the point of pivotal connection 46 of the striker 38 within the housing 28. This arrangement forms an over-center spring linkage and the movement of the point of contact 60 of the spring 58 relative to the point of pivotal connection 46 of the striker 38 establishes a condition in which the striker 38 is quickly pivoted under the influence of the extension spring 58 in the direction of arrow C of FIG. 2.

During the spring-driven pivotal motion of the striker 38 in the direction of arrow C, each foot 40 of the striker 38 strikes against the teeth 36 of a respective one of the wheels 32 and causes the wheel 32 to rotate. The mounting of the wheels 32 about the axis of rotation 34 is such that the wheels 32 are able to rotate freely. Thus, each wheel 32 is struck by the passage of the striker 38 there past and a rotating force is momentarily applied thereto. The rotation of the wheels 32 does, of course, slow and eventually stop due to friction. The continued upward movement of the slide 48 brings the retaining teeth 62 eventually into engagement between adjacent teeth 36 of the wheels 32. This engagement prevents any further rotation of the wheels 32.

Figure 3:
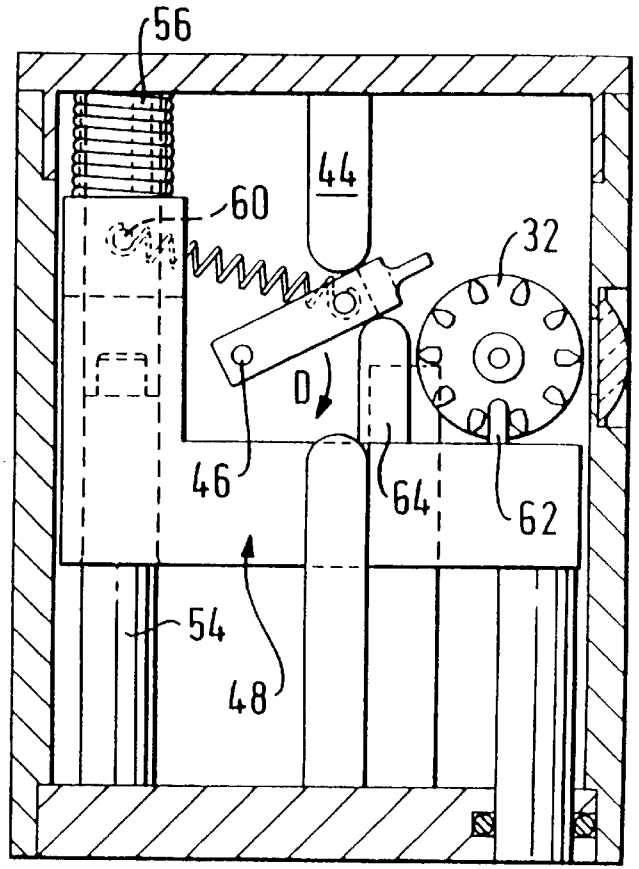
FIG. 3 shows a side view similar to that of FIG. 2 but in a different position.

This final position of the slide 48 and the striker 38 is shown in FIG. 3.

As will be appreciated, with the wheels 32 retained by the teeth 62 in the position shown in FIG. 3, indicia such as numerals provided on the circumferential surface of each of the wheels 32 are visible from outside the housing 28 by way of the display 14.

It will further be appreciated that the securing of the wheels 32 in this manner has been achieved by movement of the slide 48 upwardly and that, in its turn, this movement has been achieved by the urging of the rods 24, 26 up into the housing 28.

The fingers 64 function as a safety device to ensure that, in being moved by the spring 58 from its lower to its upper position (FIG. 2 to FIG. 3), the striker 38 is moved clear of the wheels 32. In this respect, in FIG. 3 the fingers 64 are shown in contact with the striker 38. However, in most situations the fingers 64 may not actually move upwards far enough to actually come into contact with the striker 38. The stops 42 and 44 define the maximum end positions for the spring movement of the striker 38.

FIG. 3, as described above, shows the locked and secure position of the tamper indication apparatus. In this position, and as will be appreciated, the slide 48 is held in its uppermost position against the force of the springs 56. It is the locking plate 20, and hence the rods 24 and 26, which are holding the slide 48 in this position. If then the locking plate 20 is unlocked, allowing its downward movement, the compression springs 56 located around the guide rails 54, and possibly the influence of gravity, serve to move the slide 48 downwardly from its position shown in FIG. 3 to return to the position shown in FIG. 2.

This downward movement of the slide 48 releases the retaining teeth 62 from their retaining position as shown in FIG. 3 in which they are located between adjacent teeth 36 of the wheels 32. In addition, the over-center spring linkage provided by the extension spring 58 again comes into effect in that there comes a point at which the point of contact 60 of the extension spring 58 is below the pivotal axis 46 of the striker 38 and this serves to flip the striker 38 downwardly again causing rotation of the wheels 32. This downwardly pivotal action under the influence of extension spring 58 is illustrated by arrow D in FIG. 3.

The movement of the striker in the direction of arrow D causes the rotation of the wheels 32 in a direction opposite to that effected by movement of the striker 38 in the direction of arrow C as shown in FIG. 2. Thus, once the striker 38 has arrived in the position shown in FIG. 2, the wheels 32 have been caused to rotate freely and this rotation continues until frictional force experienced during the rotation causes the rotation to cease.

As mentioned above, each of the wheels 32 is mounted for independent rotation about the axis 34 and the striking motion of the striker 38 both in the direction of arrow C, and in the direction of arrow D serves to rotate the wheels 32 in a manner which scrambles the numbers eventually visible by way of the display 14.

Thus, although one particular random number will be displayed when the mechanism is positioned as shown in FIG. 3, if the rods 24, 26 are allowed to move out of the housing 28 so as to assume the position shown in FIG. 2, and the rods are then again caused to be retracted into the housing 28 as shown in FIG. 3, i.e. if the lock apparatus 10 of FIG. 1 is opened and then relocked, the wheels 32 are spun in the two directions dictated by the pivotal motion of the striker 38 in the direction of arrows C and D such that when the retaining teeth 62 again retain the wheels 32 in a position at which they display a random number in the display 14, the probability of the same random number being displayed by the display 14 is so small as to be insignificant.

It should therefore be appreciated that any movement of the locking plate 20 will, in turn, cause movement of the rods 24, 26 which will cause the tamper indication apparatus 12 to effectively "lose" its previously displayed random number, which number cannot then be recovered.

A clear indication is then provided as to whether the lock apparatus has been tampered with, or indeed opened and relocked.

FIG. 4 shows a plan view of the apparatus of FIGS. 2 and 3 which clearly shows the slide 48 mounted on the two guide rails 54, the pivotally mounted striker 38, the extension spring 58 and the teeth 40 associated with the striker 38 and a series of seven wheels, each marked with the numerals 0–9 on their circumferential surfaces so as to provide a seven-digit random number. In this respect, it is preferred that the numbers around the circumference of each wheel 32 should not be sequential, but should be randomly arranged.

Of course, the number of wheels, as 32, provided can be chosen as required. Furthermore, the indicia on the wheels is a matter of choice. For example, some or all of the wheels may carry letters from the alphabet.

Figure 5:
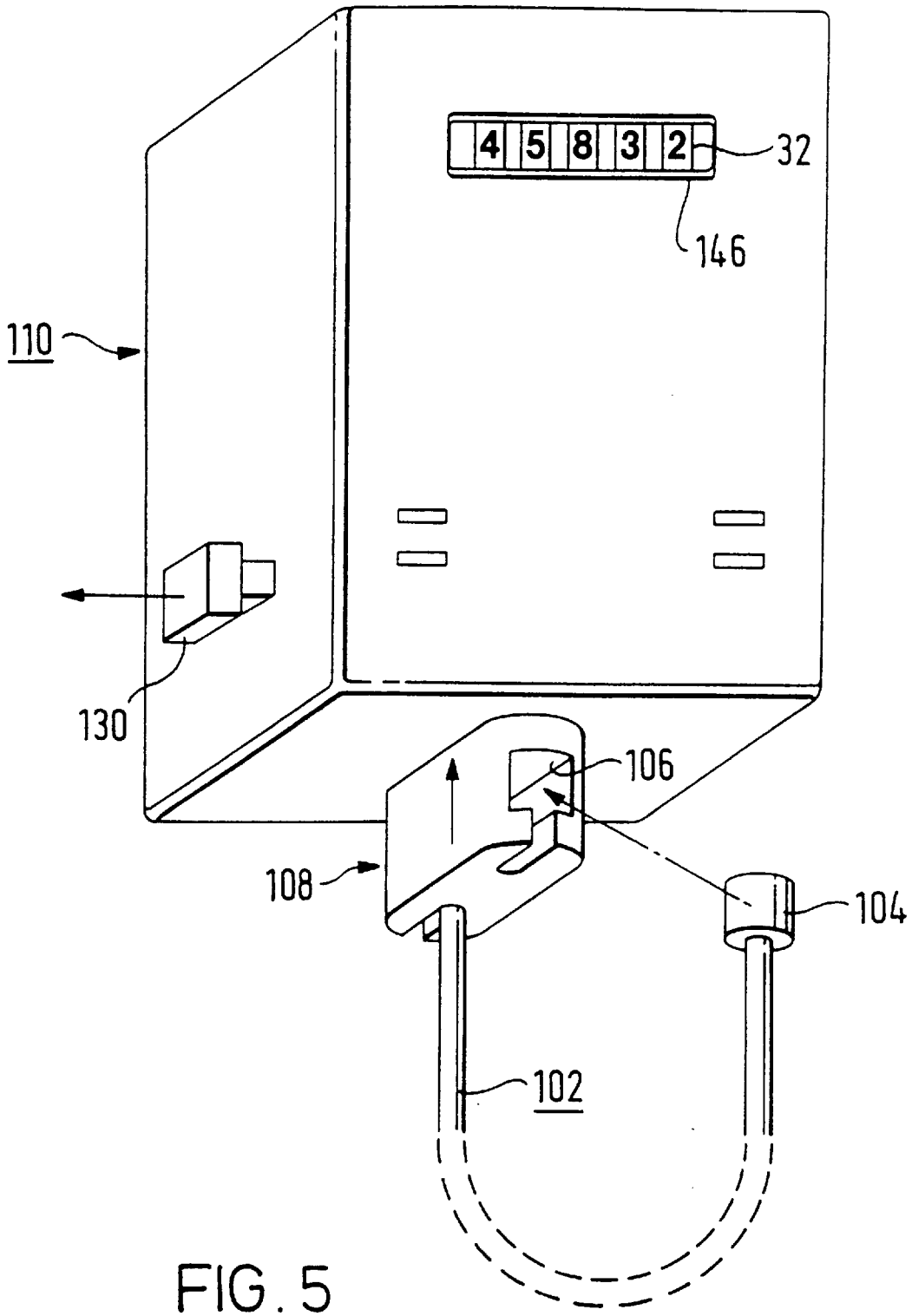
FIG. 5 shows a perspective view of an alternative embodiment of a security device embodying tamper indication apparatus.

The tamper indication apparatus of the invention has been described above as incorporated in a lock. However, the invention may be used in conjunction with any security device where it is required to know if the security device has been unlocked or tampered with. FIG. 5 shows an embodiment of tamper indication apparatus of the invention usable with a flexible cable security unit. In this respect, it is common to affix a flexible cable to prevent opening, for example, of a doorlock or other device. Such systems are frequently used, for example, on trucks.

The security unit of FIG. 5 incorporates tamper indication apparatus of the invention and also receives the ends of a cable providing, in known manner, the necessary security. A flexible cable 102, which may be a steel cable in a plastics material sheath, has at each end a termination 104, only one of which is visible in FIG. 5. Each of the terminations 104 is engageable within a respective slot 106 within a plunger 108. In this respect, both of the terminations 104 may be removably received within its associated slot 106. However, in some situations it may be preferred to have one of the terminations 104 permanently secured to the plunger 108. The plunger 108 is movable upwardly into a housing 110 of the security unit, and is captive within the housing 110.

When pushed upwardly into the housing 110, the terminations 104 are held within the housing and are not accessible.

Figure 6:
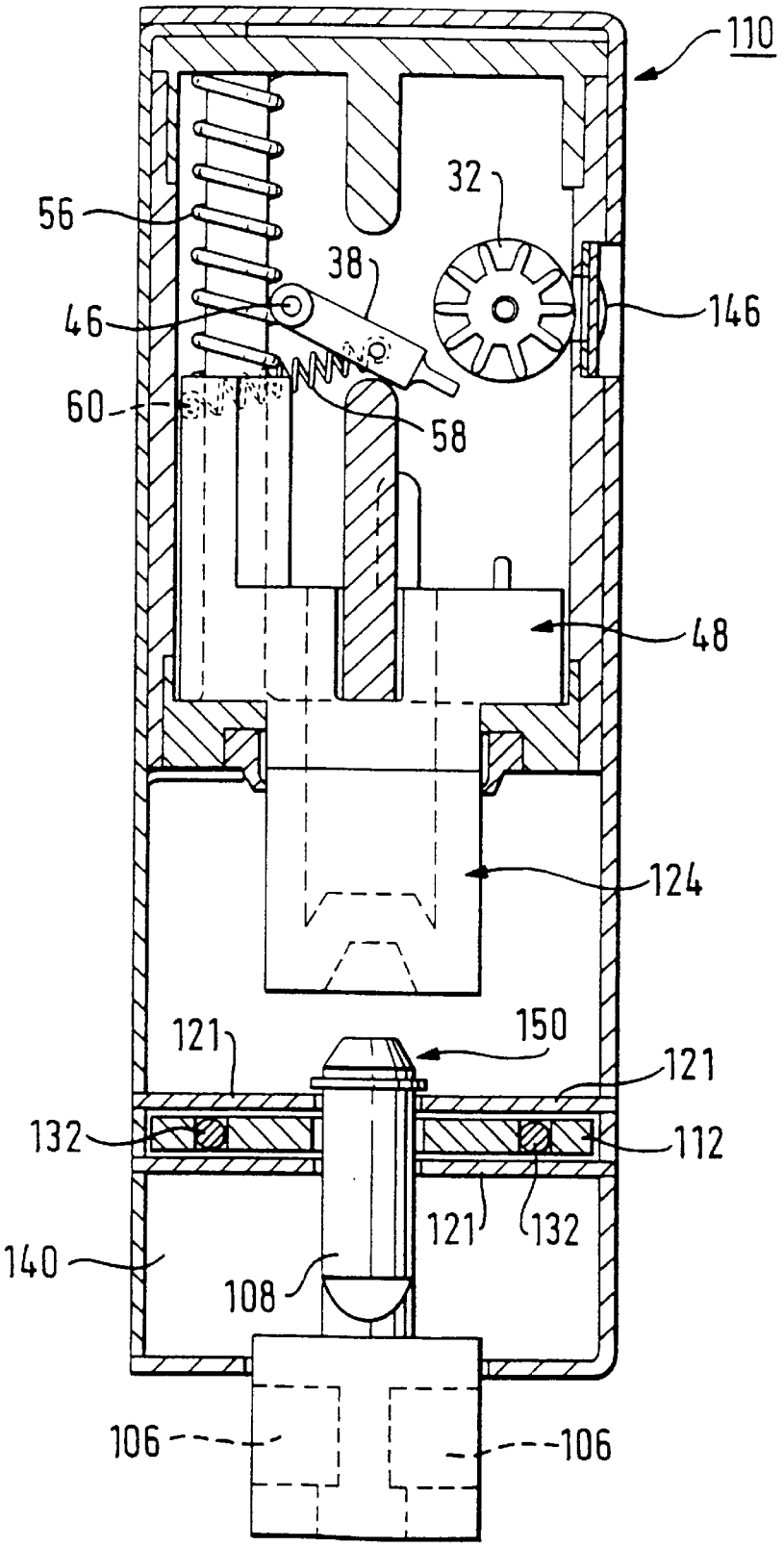
FIG. 6 is a side view of the apparatus of FIG. 5 in its unlocked position.

When pushed upwardly, the plunger 108 engages with a locking slide 112 (FIG. 6). During this engagement, the locking slide 112 is moved laterally within the housing 110. The plunger 108 also has an upper portion 150 which, in the uppermost position thereof, engages with a projection 124 of the tamper indication apparatus. In its retracted position within the housing 110, the plunger 108 is engaged by the locking slide 112 which holds it in its uppermost position. In this position, the engagement of the locking slide 112 against the plunger 108 is under spring force.

The arrangement of the security unit is such that when the two terminations 104 of the cable 102 are engaged in the plunger 108, that plunger can be pushed within the housing 110 and retained therein by the action of the slide 112 and compression springs 132. When release of the cable is required, a release knob 130 is pulled outwardly. The release knob 130 is part of the locking slide 112 which projects outwardly of the housing 110. When it is pulled outwardly the spring force urging the locking slide 112 against the plunger 108 is released, and the plunger is similarly released and is able to move downwardly.

The tamper indication apparatus of this security unit is shown in its unlocked position in FIG. 6 and it will be seen that it is very similar to the apparatus shown in FIGS. 1 to 4. In this respect, elements of FIG. 6 which are the same or similar to elements of the embodiment of FIGS. 1 to 4 have been accorded the same reference numerals.

As previously, there is a slide 48 which is arranged to be moved upwardly by the upward movement of the plunger 108. In this embodiment, the slide 48 carries a single projection 124 which is engaged, and moved upwardly, by the plunger 108 during its upward movement.

The housing 110 encloses both the tamper indication apparatus and a compartment 140 receiving the plunger 108 and the terminations 104 of the cable. The compartment 140 is defined by steel plates 121 between which the locking slide 112 is mounted.

It will be appreciated that when the plunger 108 is moved upwardly through the compartment 140, its upper portion 150 contacts and lifts the projection 124 and hence the slide 48. As described above, the upward movement of the slide 48 causes rotation of the wheels 32 by way of the over-center spring arrangement and the striker 38. Thus, the unit displays a random number by way of the window indicated at 146.

Figure 7:
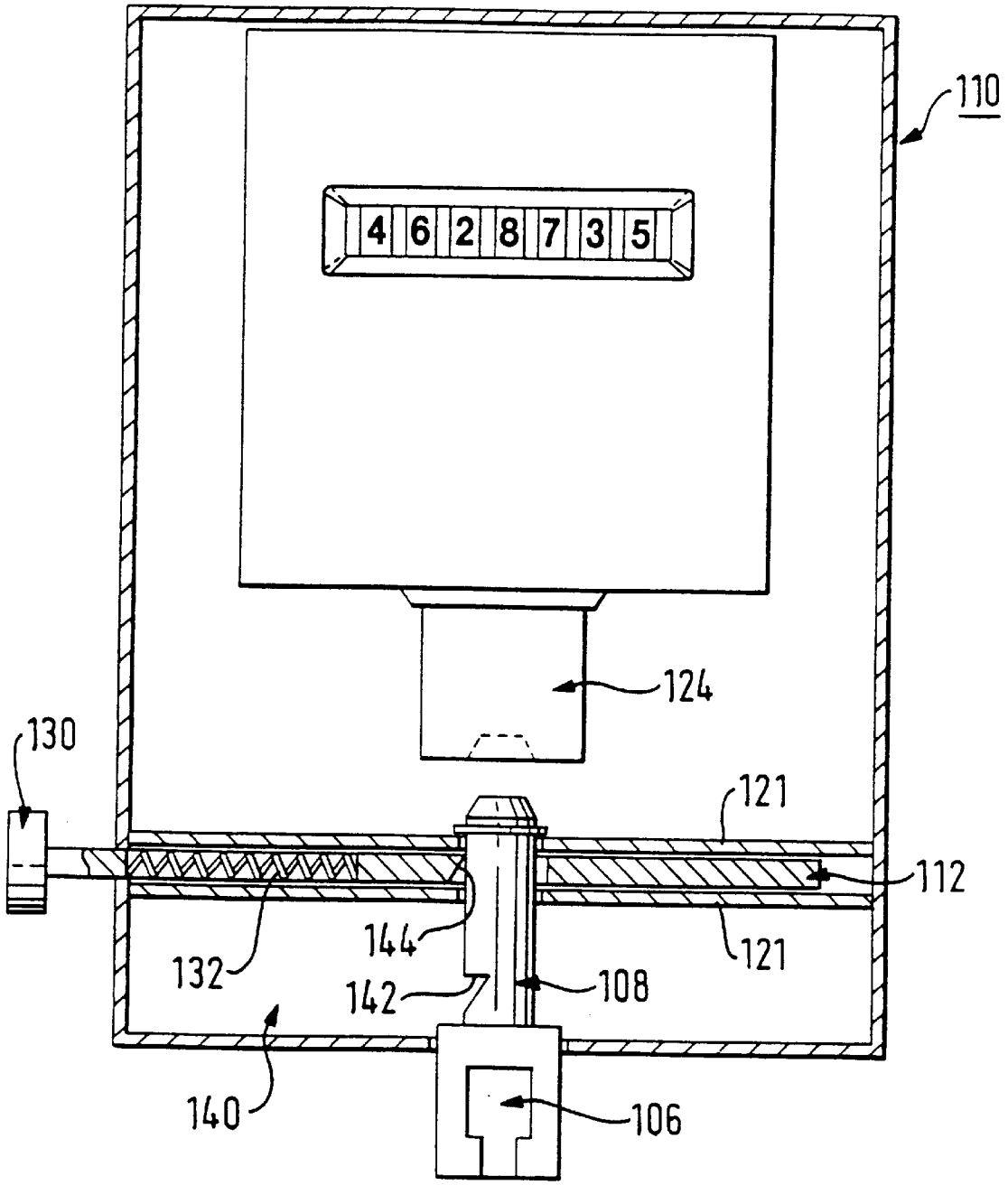
FIG. 7 is a front view of the apparatus of FIG. 5 in its unlocked position, shown partly in section.

If the release knob 130 is pulled outwardly, it moves the locking slide 112 and thus releases the plunger 108. In this respect, it will be apparent from FIG. 7 that the plunger 108 has an indent 142 which is engaged with a shaped slot of the locking slide 12 in its upper, locked position. Outward movement of the release knob 130, against the action of the compression spring 132, releases the engagement between the indent 142 and the shaped slot 144, and hence releases the plunger 108. The compression springs 56, as previously, urge the slide 48 downwardly whereby the numbers or other indicia on the wheels 32 are changed by action of the striker 38.

It will be appreciated that the security units described and illustrated hereinafter are mechanical devices and are therefore not dependent upon electrical power. In this respect, the tamper indication apparatus described herein is arranged to change the display in response to movement of an actuator which may be, or which may be moved by, a movable part of the security unit. The structure or means by which the movement of the actuator effects change of the display can be chosen as preferred. Thus, the locking and unlocking of the security unit generally involves the movement of a mechanical part and/or that a force be applied to the unit. Any arrangement for utilising that movement or force to achieve the alteration of the numbers displayed may be employed. For example, it would be possible to use hydraulic means within the tamper indication apparatus to react to the forces applied to open and close the security unit.

Of course, the nature of the display may be chosen as is required. For example, in place of the wheels 32, slides and other indicia bearing elements may be provided.

The tamper indication apparatus may be used with any type of security unit and two examples have been particularly described and illustrated herein. All that is required is that the security unit have, as an integral part of its closing arrangement, a movable member so that the movement of that member or the force applied thereto, can be utilised to also move the mechanical drive means generating the random number.

It will be appreciated that other modifications and variations may be made to this invention within the scope of appended claims.

I claim:

1. A tamper indication apparatus comprising:

an elongate rod;

a plurality of discrete wheels mounted adjacent to each other along said elongate rod, each of said wheels being independently and freely rotatable about said elongate rod, and each of said wheels having a plurality of indicia provided on a circumferential surface thereof to display said indicia, whereby said plurality of adjacent wheels together display an indicia set;

drive means for rotating said wheels to alter in a random manner the indicia set displayed by said plurality of wheels;

retainer means selectively engageable with said wheels for retaining all of said wheels against rotation; and a reciprocal slide movable by a security device associated with said tamper indication apparatus, the reciprocal slide being moved in a first direction in response to an opening movement of the security device, and the reciprocal slide being moved in a second direction, opposite to said first direction, in response to a closing movement of the security device, movement of said reciprocal slide being arranged to actuate said drive means;

wherein said drive means comprises:

a striker arm mounted for pivotal movement on a pivot axis which extends substantially parallel to said elongate rod, the striker arm carrying a plurality of individual striker feet, each striker foot being associated with a respective one of said wheels; and a drive spring connecting said striker arm and said reciprocal slide such that said striker arm is pivotal between first and second end positions, said striker arm being pivoted to said first end position by movement of said reciprocal slide in the first direction, and to said second end position by movement of said reciprocal slide in the second direction, wherein upon movement of the reciprocal slide in each direction, the drive spring drives the striker arm to said respective end position whereby each striker foot strikes and rotates said respective one of said wheels, wherein said drive spring forms an over-center spring linkage such that the striker arm is snapped into each of its end positions.

2. A tamper indication apparatus according to claim 1, in combination with a sealed housing within which said tamper indication apparatus is enclosed, and a window formed in the housing to display the indicia set provided by said wheels.

3. A tamper indication apparatus according to claim 1 or claim 2, wherein the plurality of indicia provided on the circumferential surface of each wheel are the numerals 0–9, and wherein the numerals 0–9 on each wheel are in non-sequential order.

4. A tamper indication apparatus according to claim 1, further comprising biasing means for biasing said reciprocal slide towards a first, unlocked position.

5. A tamper indication apparatus according to claim 4, wherein said reciprocal slide carries or actuates said retainer means, and wherein said retainer means are arranged to engage said wheels by movement of said slide in its first direction, against the action of said biasing means, away from said first unlocked position to a second, locked position.

6. A tamper indication apparatus according to claim 5, wherein said retainer means comprises a row of retaining teeth carried by said reciprocal slide, and each said wheel has spaced teeth in a circumferential region thereof, and wherein, in the locked position of the reciprocal slide, the retaining teeth engage the teeth of the wheels to prevent rotation of the wheels.

7. A tamper indication apparatus according to claim 6, wherein each striker foot of the striker arm is arranged, upon pivoting of the striker arm, to strike the teeth of its associated wheel.

8. A tamper indication apparatus according to claim 1, wherein each said wheel has spaced teeth in a circumferential region thereof, and each striker foot of the striker arm is arranged, upon pivoting of the striker arm, to strike the teeth of its associated wheel.

* * * * *